US009735508B2

(12) United States Patent
Dods et al.

(10) Patent No.: US 9,735,508 B2
(45) Date of Patent: Aug. 15, 2017

(54) INDEXABLE TERMINAL RETAINER AND METHOD OF MAKING PLUGS

(71) Applicant: 8521000 Canada Limited, Fitzroy Harbour (CA)

(72) Inventors: Stephen Dods, Ottawa (CA); Andrew Dods, Fitzroy Harbour (CA); Terry Dods, Ottawa (CA); Dana Budau, Carp (CA); Martin Cloake, Ottawa (CA); Jacques Sibille, L'Ange Gardien (CA); Calvin Todd Pearce, Ottawa (CA)

(73) Assignee: 8521000 Canada Limited, Fitzroy Harbour, Ontario (CA)

( * ) Notice: Subject to any disclaimer, the term of this patent is extended or adjusted under 35 U.S.C. 154(b) by 61 days.

(21) Appl. No.: 14/279,846

(22) Filed: May 16, 2014

(65) Prior Publication Data

US 2015/0072570 A1 Mar. 12, 2015

Related U.S. Application Data

(60) Provisional application No. 61/824,027, filed on May 16, 2013.

(51) Int. Cl.
*H01R 13/514* (2006.01)
*H01R 13/642* (2006.01)
*H01R 13/42* (2006.01)

(52) U.S. Cl.
CPC ..... *H01R 13/642* (2013.01); *H01R 13/42* (2013.01); *Y10T 29/49208* (2015.01)

(58) Field of Classification Search
CPC ..... H01R 13/40; H01R 43/048; H01R 4/18; H01R 13/42; H01R 13/642; H01R 13/14; H02G 3/00
USPC ..... 439/752, 695, 686, 879, 106, 650, 687, 439/171, 172, 173, 174, 175, 176, 177
See application file for complete search history.

(56) References Cited

U.S. PATENT DOCUMENTS 3,086,251 A * 4/1963 Bernat ..... B29C 45/14639 264/277
3,229,242 A * 1/1966 Finney ..... H01R 13/533 136/235
3,273,105 A * 9/1966 Klassen ..... H01R 13/533 439/679
3,360,766 A * 12/1967 Schumacher ..... H01R 13/595 174/135
3,909,095 A * 9/1975 James ..... H01R 13/652 439/106
4,194,805 A * 3/1980 Ayer ..... H01R 13/504 29/764
4,775,802 A 10/1988 Dods
4,786,261 A * 11/1988 Ramos, Jr. ..... H01R 13/533 439/469

(Continued)

*Primary Examiner* — Abdullah Riyami
*Assistant Examiner* — Nader Alhawamdeh
(74) *Attorney, Agent, or Firm* — Ware, Fressola, Maguire & Barber LLP

(57) ABSTRACT

An indexable terminal retainer for a modular wiring system includes a retainer body that retains a terminal, the retainer body being dimensioned to fit within a retainer-receiving holder of a plug or receptacle. The indexable terminal retainer further includes a locking member for locking the retainer body to the retainer-receiving holder to prevent rotation of the retainer body within the retainer-receiving holder.

11 Claims, 7 Drawing Sheets

(56) References Cited

U.S. PATENT DOCUMENTS

| | | | | | |
|---|---|---|---|---|---|
| 5,186,650 | A * | 2/1993 | Hwang | H01R 4/489 | 439/463 |
| 5,718,600 | A * | 2/1998 | D'Amario, Jr. | H01R 4/2491 | 439/410 |
| 5,913,574 | A * | 6/1999 | D'Amario, Jr. | H01R 4/2491 | 30/90.1 |
| 6,328,581 | B1 * | 12/2001 | Lee | H01R 31/06 | 439/106 |
| 6,780,033 | B2 * | 8/2004 | Liu | H01R 31/06 | 439/172 |
| 7,300,297 | B1 * | 11/2007 | Wang | H01R 13/2442 | 439/173 |
| 7,303,416 | B1 * | 12/2007 | Liao | H01R 13/633 | 439/173 |
| 7,413,478 | B2 * | 8/2008 | Kleinschmidt | H01R 4/64 | 439/686 |
| 7,553,171 | B2 * | 6/2009 | Wang | H01R 13/4226 | 439/106 |
| 8,540,535 | B2 * | 9/2013 | Martens | H01R 4/00 | 439/866 |
| 8,876,541 | B1 * | 11/2014 | Wu | H01R 27/00 | 439/173 |
| 2004/0038572 | A1 * | 2/2004 | Liu | H01R 31/06 | 439/172 |
| 2009/0215323 | A1 * | 8/2009 | Chang | H01R 4/029 | 439/695 |
| 2010/0304620 | A1 * | 12/2010 | Huang | H01R 13/562 | 439/686 |
| 2010/0328853 | A1 * | 12/2010 | Johnson | H01R 25/16 | 361/641 |

* cited by examiner

INDEXABLE TERMINAL RETAINER AND METHOD OF MAKING PLUGS

CROSS-REFERENCE TO RELATED APPLICATIONS

This application claims priority from U.S. Provisional Patent Application 61/824,027, filed 16 May 2013.

TECHNICAL FIELD

The present technology relates generally to electrical plugs and receptacles and in particular to plugs and receptacles for modular wiring systems.

BACKGROUND

Buildings intended for commercial or retail office space are generally constructed in a manner which permits the sectioning off of selected floor areas according to the wishes of a tenant to provide individual offices in accordance with an office floor plan designed by or for the individual tenant. Since the tenancy on any particular floor of an office building might be expected to change every few years or so, it is important that the lighting installation of each floor of the building be of a type which is relatively easily modified and rewired so that individual offices, conference rooms, kitchen and reception areas, etc. can be sectioned off and provided with their own overhead lights and light switch.

For this reason, it is advantageous to use a modular wiring system made up of separate interconnecting components for wiring together the light fixtures and other electrical components of an office or retail space. The more simple the design and construction of the wiring components, the more advantageous is the system. Likewise, the more simple the method of wiring together the components, the more advantageous is the system. However, a simple design and wiring method alone are not the only objectives of an efficient wiring system; it is also desirable that the components of the wiring system be easy to work with in that they be manageable and "foolproof" (i.e. designed so that only designated components of the system are capable of being connected to other components in accordance with the intended wiring method).

Modular wiring systems may be used for wiring light fixtures, control systems, devices, switches, panels and other electrical equipment in both residential and commercial construction. Modular "plug-and-play" components reduce installation time and enable quick, safe and cost-effective alterations. Pre-terminated connections provide an economical solution for flexible environments, tenant fit-up, retail display or renovations. Modular wiring systems dramatically reduce labour costs compared to hard wiring methods.

A modular wiring system is disclosed in U.S. Pat. No. 4,775,802, which is hereby incorporated in its entirety.

Further improvements on this and other known modular wiring technologies remain highly desirable.

SUMMARY

In general, the present invention provides an indexable terminal retainer for a plug or receptacle of a modular wiring system. The indexable terminal retainer may be installed in one of a plurality of configurations relative to a retainer-receiving holder of the plug or receptacle. The indexable terminal retainer is thus detachably lockable in any one of a number of different positions (orientations) within the holder. The indexable terminal retainer facilitates the assembly of a variety of different plug or receptacle configurations by simply inserting the indexable terminal retainers into the holders with the correct orientation.

Thus, an aspect of the present invention is an indexable terminal retainer for a modular wiring system. The indexable terminal retainer includes a retainer body that retains a terminal, the retainer body being dimensioned to fit within a retainer-receiving holder of a plug or receptacle, and a locking member for locking the retainer body to the retainer-receiving holder to prevent rotation of the retainer body within the retainer-receiving holder.

Another aspect of the present invention is a plug for a modular wiring system. The plug includes a plug body having a retainer-receiving holder, an indexable terminal retainer having a retainer body that retains a terminal, the retainer body having a body dimensioned to fit within the holder, and a locking member for locking the retainer body to the retainer-receiving holder to prevent rotation of the retainer body within the retainer-receiving holder.

Another aspect of the present invention is a receptacle for a modular wiring system. The receptacle includes a receptacle body having a retainer-receiving holder, an indexable terminal retainer having a retainer body that retains a terminal, the retainer body having a body dimensioned to fit within the holder, and a locking member for locking the retainer body to the retainer-receiving holder to prevent rotation of the retainer body within the retainer-receiving holder.

Yet another aspect of the present invention is a method of making or assembling a plug or receptacle for a modular wiring system. The method entails providing an indexable terminal retainer, rotating the indexable terminal retainer to a desired angular orientation relative to a retainer-receiving holder and installing the terminal retainer in the holder of the plug or receptacle.

Other aspects of the invention are described below in relation to the accompanying drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

The embodiments of the present invention provide, in general, an indexable terminal retainer either for a plug of a modular wiring system or for a receptacle of a modular wiring system. The indexable terminal retainer has first and second retainer components that come together to retain the terminal, e.g. the pin connector or pin socket. The terminal retainer is then inserted (installed) in a retainer-receiving holder of the plug or receptacle. The indexable terminal retainer is locked in an angular orientation by a locking member that locks the indexable terminal retainer to the holder, for example by one or more radial protrusions such as anti-rotation ribs or locking ribs.

Figure 1:
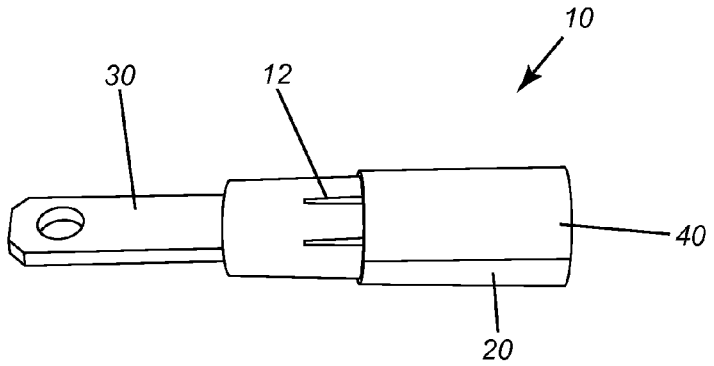
FIG. 1 is an isometric view of a terminal retainer in accordance with one embodiment of the present invention.

FIG. 1 illustrates an indexable terminal retainer generally designated by reference numeral 10 which is designed for use in a modular wiring system. The terminal retainer 10 may be made of an electrically insulating material, for example, by molding any suitable polymer such as a thermoplastic like acrylonitrile butadiene styrene (ABS) or polyvinyl chloride (PVC).

As illustrated in FIG. 1, the indexable terminal retainer 10 has a retainer body that retains a terminal 30. The retainer body is dimensioned to fit within a retainer-receiving holder of a plug or receptacle. The indexable terminal retainer includes a locking member for locking the retainer body to the retainer-receiving holder to prevent rotation of the retainer body within the retainer-receiving holder, as will be further described and illustrated.

In the illustrated embodiments, the indexable terminal retainer 10 includes a locking member for locking the retainer body to the retainer-receiving holder to prevent rotation of the retainer body within the retainer-receiving holder. Where the indexable terminal retainer has a retainer body that is substantially cylindrical, the locking member may be a radial protrusion that extends radially outwardly from an outer surface of the body to engage a groove in the retainer-receiving holder. The radial protrusion may be a rib 12. In one embodiment, there may be a plurality of equally spaced anti-rotation locking ribs extending longitudinally along the outer surface of the retainer body for engaging respective grooves in the retainer-receiving holder.

The terminal 30 that is retained by the indexable terminal retainer 10 is made of an electrically conductive material (e.g. copper, copper alloy, etc.) that is adapted to be electrically joined (e.g. by crimping or by any other method) to an electrical wire (not shown).

For the purposes of this specification, the terminal may be a connector pin (male terminal or male connector) or a pin socket (female terminal or female connector). The connector pin may be part of a (male) plug or a (male) receptacle. The pin socket may be part of a (female) plug or a (female) receptacle. The connector pin itself may have different shapes, e.g. cylindrical prongs, flat blades, etc. Likewise, the pin sockets may have corresponding shapes to accommodate any shape of prongs or blades as the case may be.

The indexable terminal retainer 10 may, in one embodiment, be made by joining a first retainer component 20 to a second retainer component 40 to retain a terminal 30 in between the first and second retainer components. The first and second retainer components may be press-fitted or snapped together, bonded by chemical adhesive, ultrasonically welded, or welded using thermoplastic welding techniques, or any combination thereof, etc. The terminal 30 may have crimping wings disposed on a rearward portion of the terminal for crimping, or any other method, the terminal to the wire. The terminal retainer includes an aperture for the wire to extend out of the terminal retainer.

Figure 2:
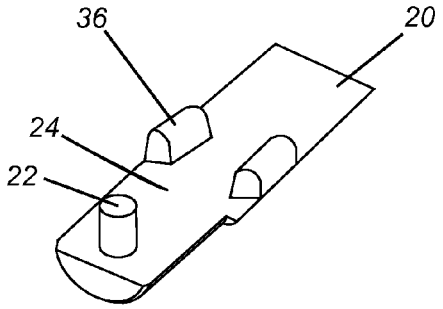
FIG. 2 is an isometric view of a plug showing the retainer-receiving holders into which the retainers are inserted.

As illustrated in FIG. 2, an internal post 22 protrudes from an inner surface 24 of the first retainer component 20. The post illustrated in FIG. 2 is circular in cross section although, in other variants, the post may have any other cross-sectional profile, e.g. square, rectangle, triangle, pentagon, hexagon, octagon, semicircular, etc, or even an irregular or asymmetrical shape. A terminal 30 made of an electrically conductive material (e.g. copper, copper alloy, etc.) is adapted to be electrically joined (e.g. by crimping, or any other method) to an electrical wire (not shown). The terminal has a hole 32 for mounting the terminal on the post 22. The hole is circular in FIG. 2 (to match the post) but any other shape of hole could be employed provided it matches the post. The terminal abuts a support 36 or stop to prevent the terminal from rotating inside the retainer.

The terminal retainer 10 also includes a second retainer component 40 which is also made of the electrically insulating material. The second retainer component 40 is adapted to attach to the first retainer component to form the terminal retainer. The first and second retainer components may be press-fitted or snapped together, bonded by chemical adhesive, ultrasonically welded, or welded using thermoplastic welding techniques, or any combination thereof, etc.

Figure 3:
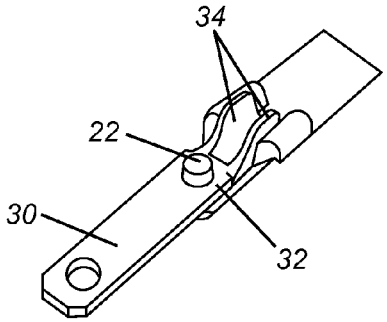
FIG. 3 is an isometric view of the plug with the indexable terminal retainers into the holders.

As illustrated in FIG. 3, the terminal 30 has crimping wings 34 disposed on a rearward portion 36 of the terminal for crimping the terminal to the wire. The terminal retainer includes an aperture for the wire to extend out of the terminal retainer.

In the embodiment depicted in FIG. 3, the terminal is a flat blade pin connector. The inner surface is flat, as shown in FIG. 2, in order to accommodate such a terminal.

Figure 4:
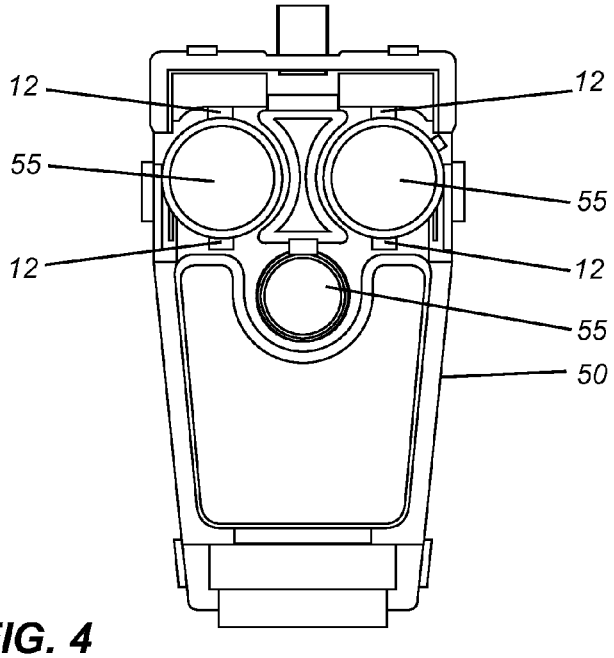
FIG. 4 is a front view of a receptacle showing the retainer-receiving holders into which the retainers are inserted.

FIG. 4 illustrates a plug 50 having retainer-receiving holders 55 into which the retainers 10 are inserted to assemble the plug. The retainer-receiving holders are sockets shaped to match the terminal retainers. In this embodiment, the holders are circular in cross-section to accommodate the cylindrically-shaped body of the terminal retainers. In most embodiments, it is advantageous to design and manufacture the terminal retainers and holders with appropriate tolerances so that the retainers can be finger-pressed into the holders for manual or robotic assembly. For terminal retainers having a rounded body such as the ones shown in the illustrations, it is useful to provide a plurality of anti-rotation ribs 12 disposed on the outer surface of the terminal retainer for preventing rotation of the terminal retainer when installed inside a respective round retainer-receiving holder of a plug or receptacle. These longitudinally aligned ribs 12 interact with longitudinally aligned ridges protruding from the round inner surface of the holder to lock the retainer in one angular orientation and thus to prevent the retainer from rotating inside its respective holder.

Figure 5:
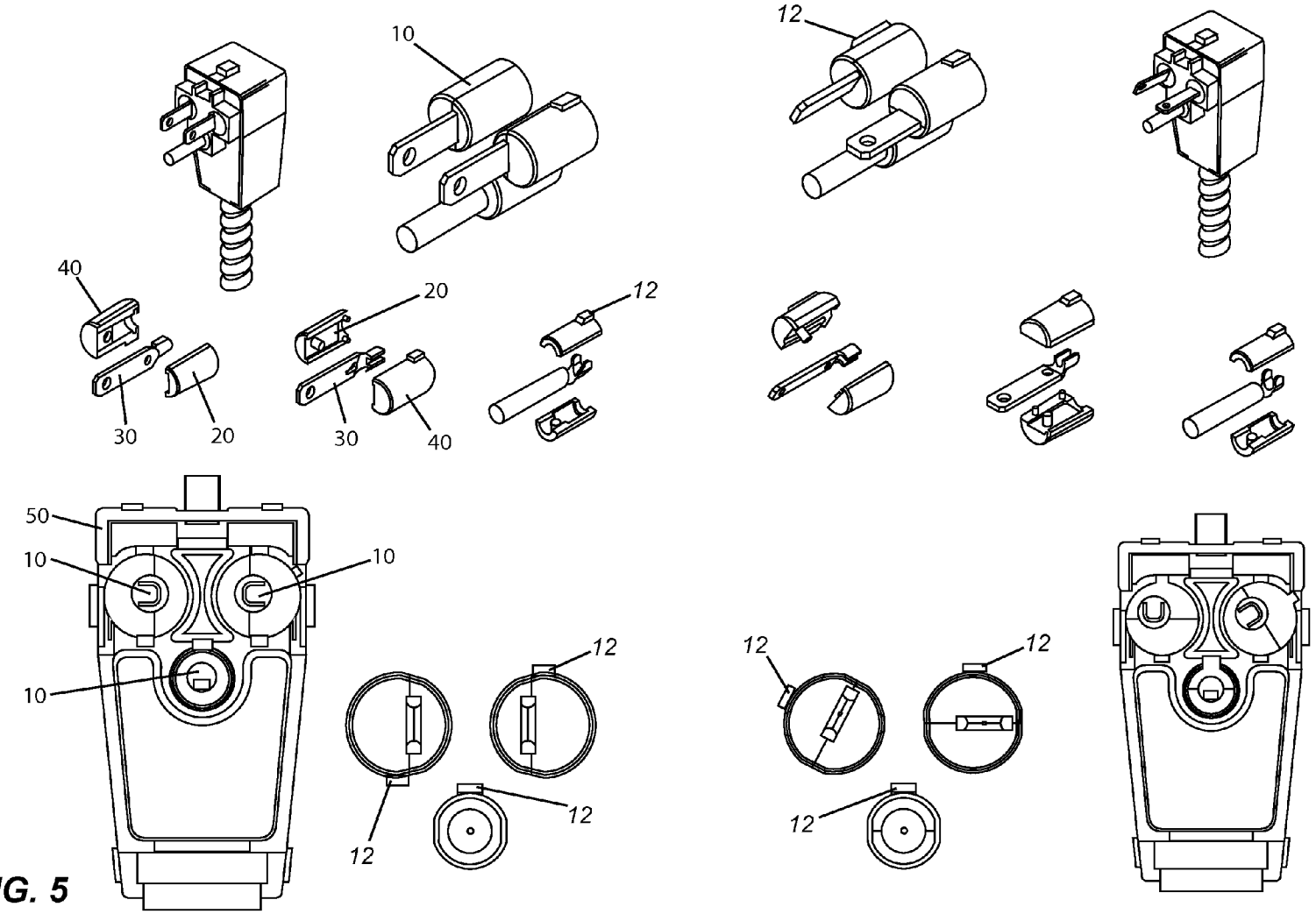
FIG. 5 is a front view of the receptacle with the terminal retainers installed in the retainer-receiving holders.

FIG. 5 is an isometric view of the plug 50 with the terminal retainers 10 installed in the retainer-receiving holders 55. Although in the illustrated embodiment the plug has three pins, it will be appreciated that this technology may be applied to any other plug or receptacle having any other configuration or number of pins. It will also be understood that in some cases, differently sized or shaped terminal retainers may be installed in the same plug or receptacle.

The indexable terminal retainers may be inserted into the holders of the plug or receptacle in various orientations. This enables plugs or receptacles of different configurations to be assembled.

FIGS. 6 to 11 illustrate various examples of plugs and receptacles assembled using these indexable terminal retainers.

Figure 6:
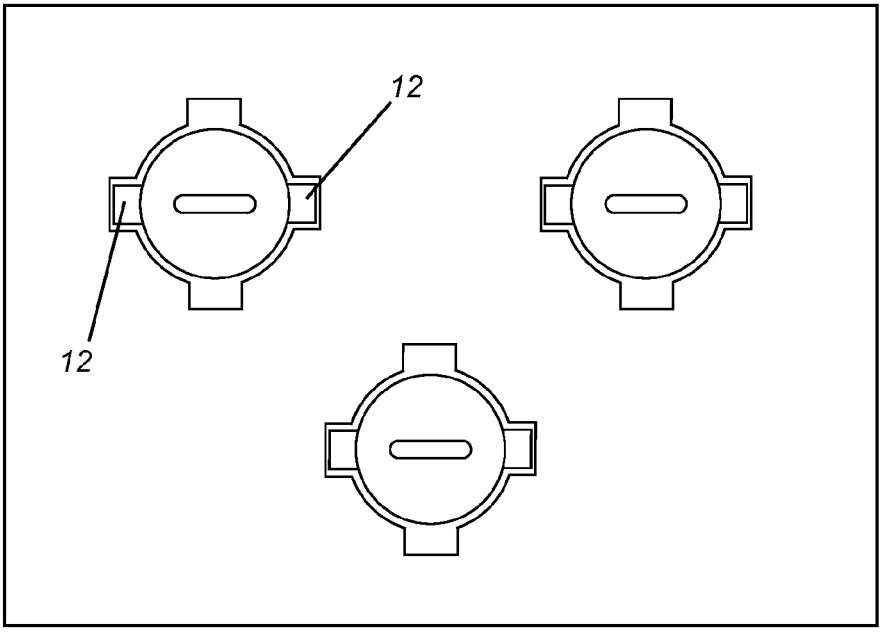
FIG. 6 is a front view of a three-pin receptacle with the indexable terminal retainers in a first orientation such that the blades are horizontal.

FIG. 6 is a front view of a three-pin receptacle with the indexable terminal retainers in a first orientation such that the blades are horizontal. In the embodiment depicted in FIG. 6, the terminal is a flat blade pin connector. The holders in this example shown in FIG. 6 have four grooves (or channels or keyways) that enable the radial protrusions (e.g. ribs, ridges, keys, splines or the like) that slide into each of the grooves, e.g. with a sliding-fit tolerance or any other suitable tolerance. In this example, the indexable terminal retainer has two ribs. Therefore, the ribs of the retainer can fit into the grooves of the holder in either a vertical orientation or a horizontal orientation. For each of the three pins, the orientation may be either horizontal or vertical, thus providing eight possible combinations of configurations for the receptacle. Therefore, eight different configurations of receptacles cane be created using the same indexable terminal retainers and the same receptacle body. This simplifies and facilitates manufacturing operations.

Figure 7:
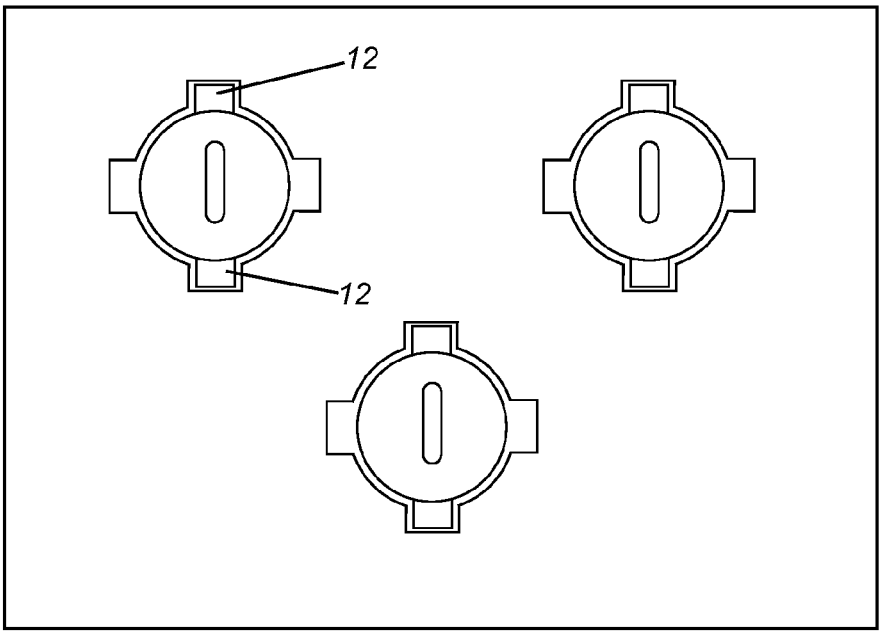
FIG. 7 is a front view of a three-pin receptacle with the indexable terminal retainers in a second orientation such that the blades are vertical.

FIG. 7 is a front view of a three-pin receptacle with the indexable terminal retainers in a second orientation such that the blades are vertical. FIG. 7 shows how a different configuration may be made using the same terminal retainers and receptacle body. In most embodiments, the indexable terminal retainers are detachably installed into the holders such that these retainers may be removed from the holders without breaking or damaging them. Accordingly, the retainers may be removed and reinserted into the holder at a different orientation. This enables manufacturing/assembly errors to be corrected quickly, easily and without wasting material or subcomponents. In other embodiments, however, the retainer may be designed to be permanently installed in the holder although it is generally more advantageous to provide a detachably mounted design for the retainer and holder.

In some embodiments, the retainer must be completely removed from the holder before it can be rotated into a new orientation. In other embodiments, the retainer need only be partially removed from the holder before it can be rotated into a new orientation.

The concepts disclosed herein may be applied to plugs as well as receptacles, and to plugs or receptacles having any number or configuration of pins.

Figure 8:
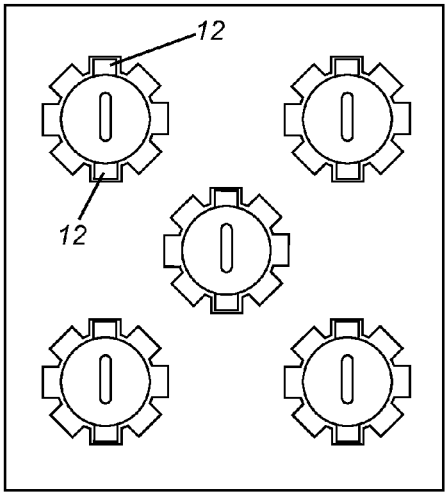
FIG. 8 is a front view of a five-pin plug with the indexable terminal retainers in a first orientation such that the blades are horizontal.

FIG. 8 is a front view of a five-pin plug with each of the indexable terminal retainers in a first orientation such that the blades are all horizontal. Each retainer may be placed in one of four possible orientations (vertical, horizontal, angled/inclined to the right, angled/inclined to the left). Each of the five pins may be oriented in four different ways, thus providing in this instance 1024 combinations. Again, all 1024 combinations may be made using a single type of terminal retainer and a single plug body.

Figure 9:
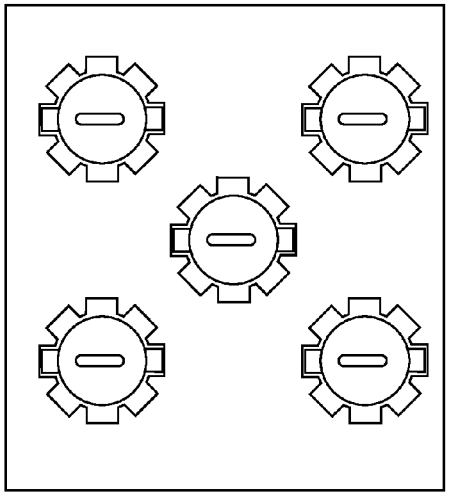
FIG. 9 is a front view of a five-pin plug with the indexable terminal retainers in a second orientation such that the blades are vertical.
Figure 10:
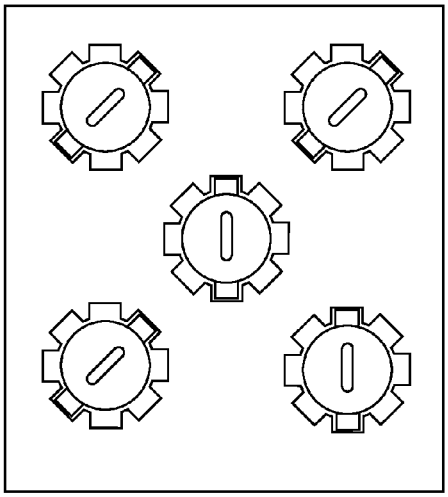
FIG. 10 is a front view of a five-pin plug with the indexable terminal retainers in a first mix of vertical, horizontal and angled orientations.
Figure 11:
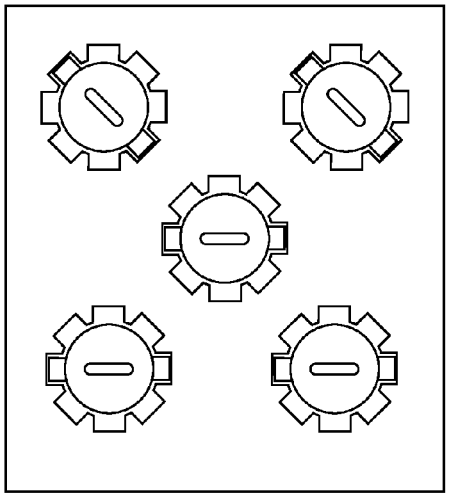
FIG. 11 is a front view of a five-pin plug with the indexable terminal retainers in a second mix of vertical, horizontal and angled orientations.

A few of these possible combinations are depicted as further examples to illustrate the inventive concept. For example, FIG. 9 is a front view of a five-pin plug with each of the indexable terminal retainers in a second orientation such that the blades are all vertical. FIG. 10 is a front view of a five-pin plug with the indexable terminal retainers in a first mix of vertical, horizontal and angled orientations. FIG. 11 is a front view of a five-pin plug with the indexable terminal retainers in a second mix of vertical, horizontal and angled orientations.

Figure 12:
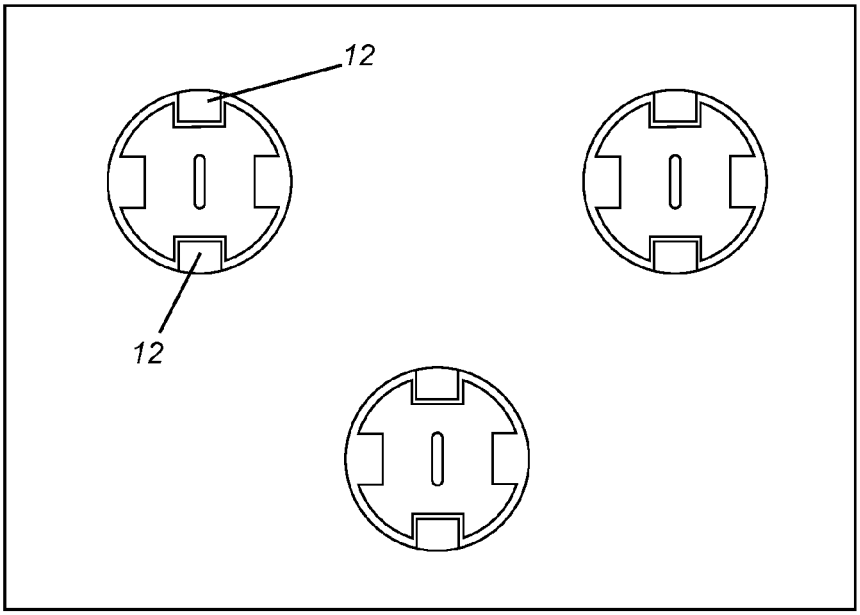
FIG. 12 is a front view of a three-pin receptacle in accordance with another embodiment of the present invention in which the terminal retainer body has grooves for receiving radial protrusions extending radially inwardly from each of the holders.

FIG. 12 is a front view of a three-pin receptacle in accordance with another embodiment of the present invention in which the terminal retainer body has grooves for receiving radial protrusions extending radially inwardly from each of the holders. In FIG. 12, the radial protrusions of all three holders are vertical.

Figure 13:
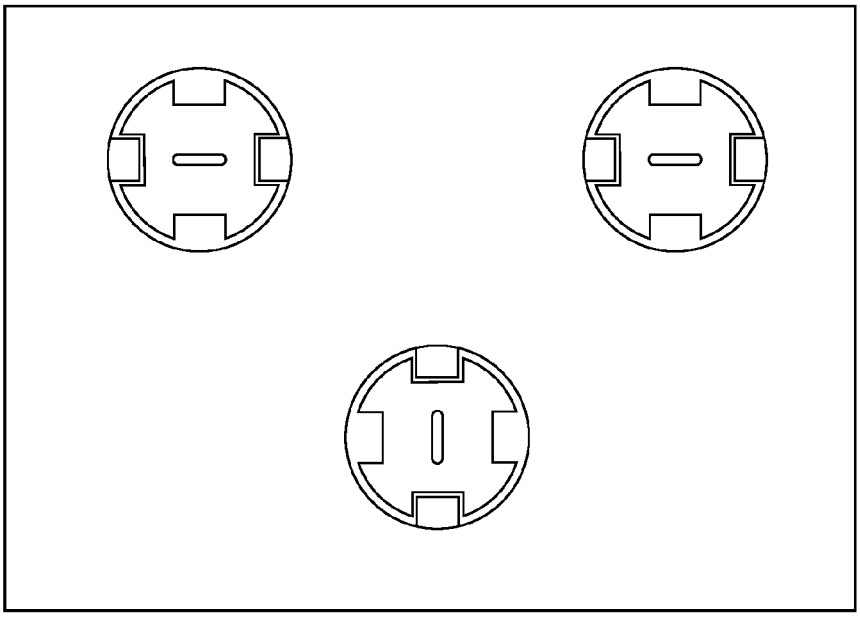
FIG. 13 is a front view of another configuration of the three-pin receptacle shown in FIG. 12.

FIG. 13 is a front view of another configuration of the three-pin receptacle shown in FIG. 12. In FIG. 13, the two upper holders have radial protrusions that are horizontal whereas the lower holder has radial protrusions that are vertical. The holders may be arranged in other configurations. Although in the illustrated embodiment the plug has three pins, it will be appreciated that this technology may be applied to any other plug or receptacle having any other configuration or number of pins. It will also be understood that in some cases, differently sized or shaped terminal retainers may be installed in the same plug or receptacle having correspondingly sized and shaped holders.

Figure 14:
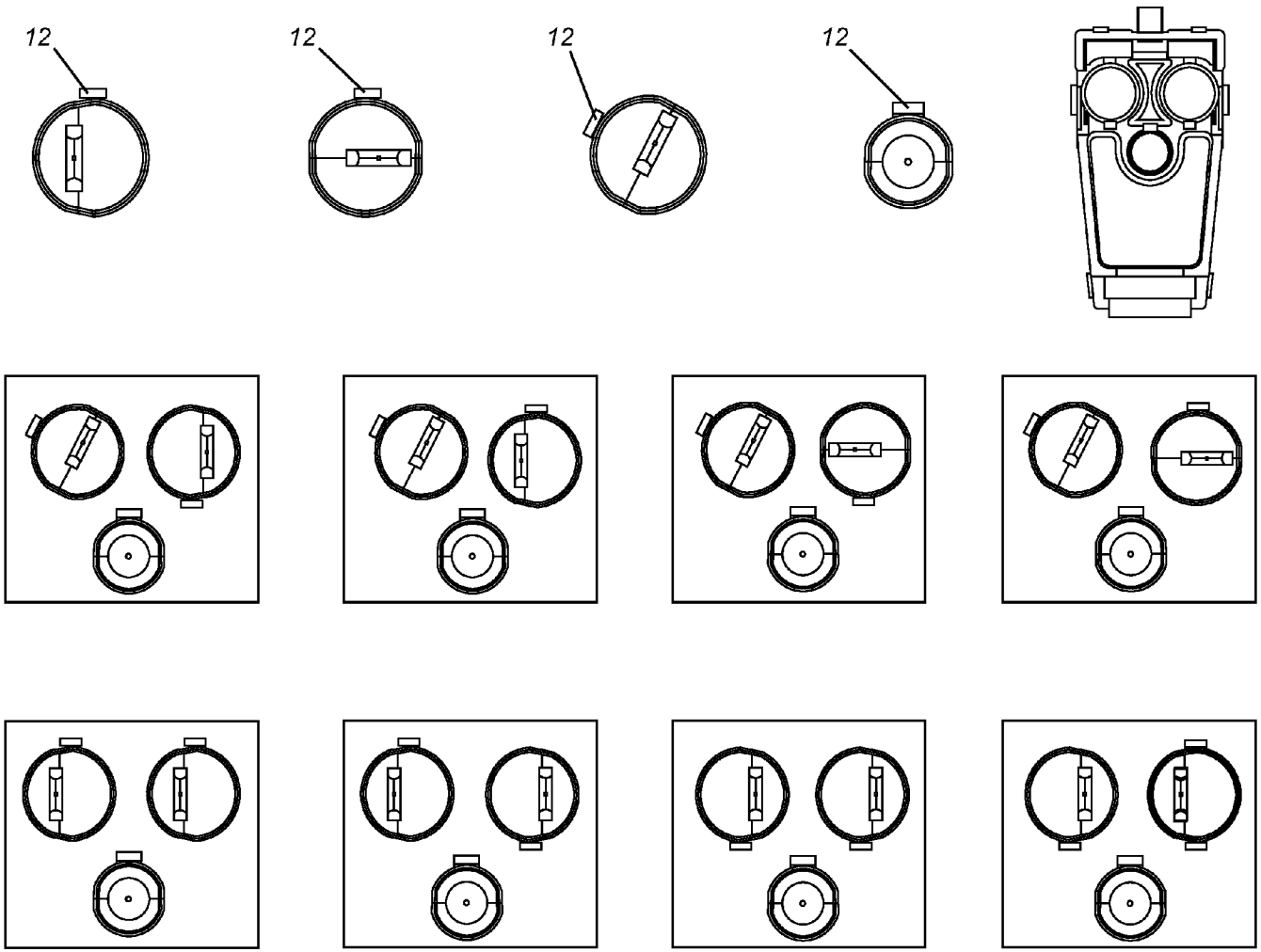
FIG. 14 depict various configurations for a 3-pin male plug.

FIG. 14 depict various configurations for a 3-pin male plug. Each blade may be vertical, horizontal or at 60 degrees.

Figure 15:
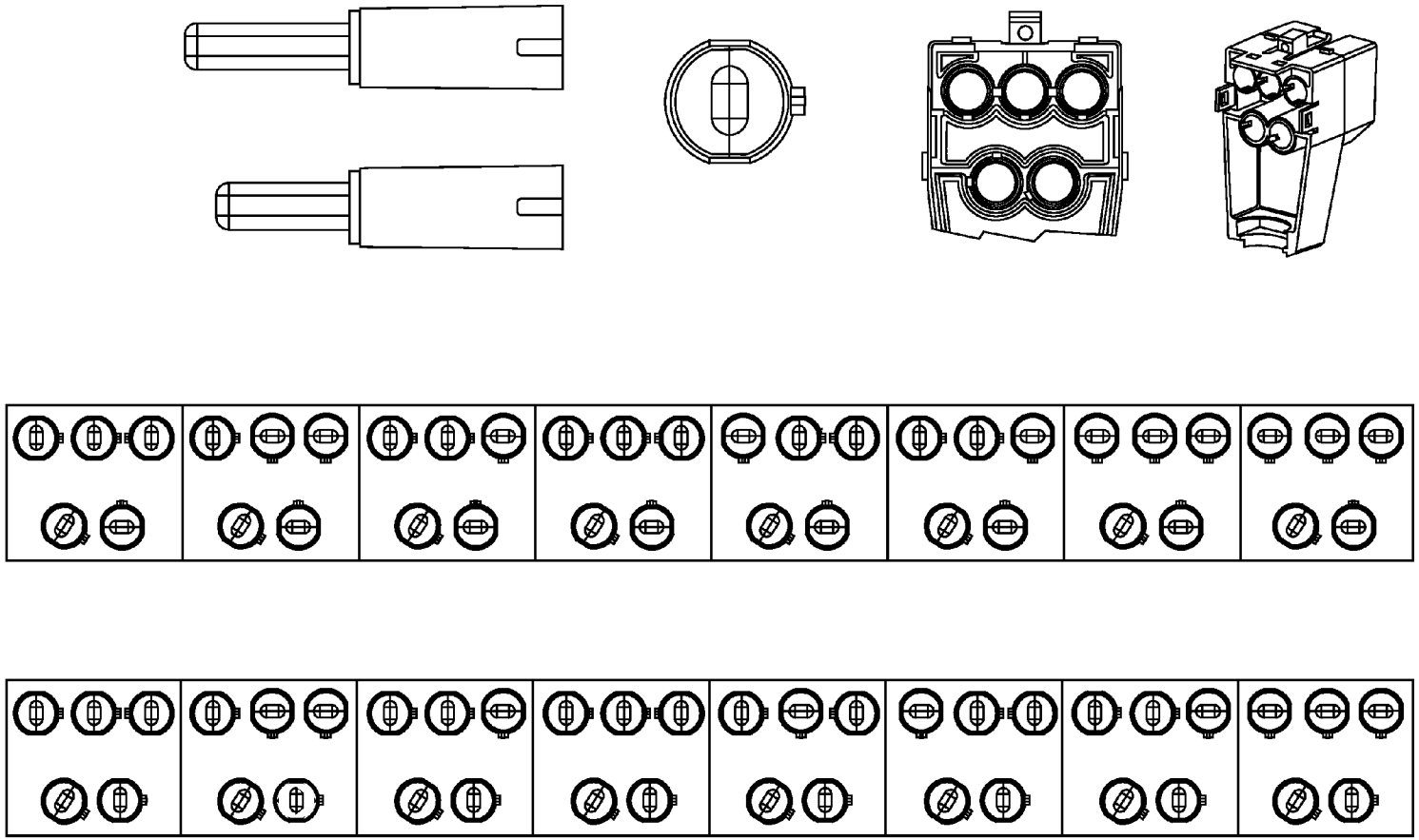
FIG. 15 depict various configurations for a 5-pin male plug.

FIG. 15 depict various configurations for a 5-pin male plug. The pin at 60 degrees stays at that position. Each of the other four pins has two possible positions resulting in 16 possible configurations.

From the foregoing, it is observed that the retainer-receiving holders are sockets shaped to substantially match the shape of the indexable terminal retainers. In the illustrated embodiments, the holders are generally circular in cross-section to accommodate the generally cylindrically-shaped body of the indexable terminal retainers. In most embodiments, it is advantageous to design and manufacture the terminal retainers and holders with appropriate tolerances so that the retainers can be finger-pressed into the holders for manual assembly although the manufacturing process may be performed robotically. For terminal retainers having a rounded body such as the ones shown in the illustrations, it is useful to provide a plurality of anti-rotation ribs disposed on the outer surface of the terminal retainer for preventing rotation of the terminal retainer when installed inside a respective round retainer-receiving holder of a plug or receptacle. These longitudinally aligned ribs interact with longitudinally aligned ridges protruding from the round inner surface of the holder to lock the retainer in one angular orientation and thus to prevent the retainer from rotating inside its respective holder.

In the foregoing embodiments, the terminal retainer comprises radial protrusions such as a plurality of anti-rotation ribs disposed on the outer surface of the indexable terminal retainer for interlocking with grooves inside the holders to thereby prevent rotation of the terminal retainer when installed inside a respective retainer-receiving holder of a plug or receptacle.

In another embodiment, the indexable terminal retainer is rotatable within the holder in fixed angular increments without removing the retainer from the holder. In the foregoing embodiments, the terminal retainer had to be removed, or at least partially removed, from the holder before it could be rotated because of the interference between the ribs and the grooves that prevented rotation of the retainer within the holder. However, in a further embodiment, the radial protrusions are stubbier and designed with a minimal interference fit so as to be easily rotatable within the holder from a first orientation to a second orientation without shearing the protrusion or causing undue wear to the protrusion or groove of the holder. As such, in this further embodiment, the indexable terminal retainer may be rotated within the holder while the terminal retainer is fully inserted into the holder.

One main advantage of this modular design is that it facilitates assembly by permitting terminal retainers that retain different types of terminals (e.g. prongs, blades, etc.) to be used interchangeably to create different types of plugs and receptacles. It also enables terminal retainers to be removed and replaced. For example, in an assembly operation, plug bodies each having a certain number and configuration of empty terminal-receiving holders (sockets) can be used for assembling different types of plug by simply inserting terminal retainers having the desired type of terminal. Thus, the same plug bodies can be converted into male plugs with blade terminals, male plugs with cylindrical prongs, male plugs with any combination of blades and prongs, female plugs with blade sockets, female plugs with prong sockets, or female plugs with any combination of blade sockets and prong sockets. Similarly, different types of receptacles may be assembled by inserting terminal retainers having different terminals into a receptacle body having commonly sized retainer-receiving holders (socket). This technology thus provides tremendous flexibility in the manufacturing process.

Another aspect of the inventive subject matter of this disclosure is a method for assembling a plug or a receptacle of a modular wiring system. The method entails providing an indexable retainer terminal, rotating the indexable retainer terminal to a desired angular orientation relative to a terminal-receiving holder in the plug or receptacle, and installing the indexable terminal retainer in the retainer-receiving holder of the plug or receptacle. In one implementation of this method, installing the indexable terminal retainer may involve inserting one or more radial protrusions that extend radially outwardly from an outer surface of the terminal body into respective grooves in the retainer-receiving holder.

The method may further include prior steps of assembling the terminal retainer itself. This may involve providing a first retainer component made of an electrically insulating material, the first retainer component having an inner surface from which protrudes an internal post, mounting on the post a terminal made of an electrically conductive material, crimping an electrical wire to the terminal, attaching a second retainer component also made of the electrically insulating material to the first retainer component. Once the terminal retainer has been assembled, the terminal retainer may then be installed in a retainer-receiving holder of the plug or receptacle.

This new technology has been described in terms of specific implementations and configurations which are intended to be exemplary only. Persons of ordinary skill in the art will appreciate that many obvious variations, refinements and modifications may be made without departing from the inventive concepts presented in this application. The scope of the exclusive right sought by the Applicant(s) is therefore intended to be limited solely by the appended claims.

The invention claimed is:

1. An indexable terminal retainer for a modular wiring system, the indexable terminal retainer comprising:

a cylindrical retainer body that retains only a single terminal, the retainer body being dimensioned to fit within a retainer-receiving holder of a plug or receptacle, wherein the retainer-receiving holder defines a cylindrically shaped socket that matches the cylindrical retainer body; and a locking member for locking the retainer body to the retainer-receiving holder to prevent rotation of the retainer body, wherein the locking member is shaped to fit within one of a plurality of identically shaped but differently oriented grooves in the retainer-receiving holder.

2. The indexable terminal retainer as claimed in claim 1, wherein the locking member is a radial protrusion that extends radially outwardly from an outer surface of the retainer body to engage one of the grooves in the retainer-receiving holder.

3. The indexable terminal retainer as claimed in claim 2 comprising a plurality of equally spaced anti-rotation locking ribs extending longitudinally along the outer surface of the retainer body for engaging respective grooves in the retainer-receiving holder.

4. A plug for a modular wiring system, the plug comprising:

a plug body having a retainer-receiving holder;

an indexable terminal retainer having a cylindrical retainer body that retains only a single terminal, the retainer body having a body dimensioned to fit within the retainer-receiving holder, wherein the retainer-receiving holder defines a cylindrically shaped socket that matches the cylindrical retainer body; and a locking member for locking the retainer body to the retainer-receiving holder to prevent rotation of the retainer body, wherein the locking member is shaped to fit within one of a plurality of identically shaped but differently oriented grooves in the retainer-receiving holder.

5. The plug as claimed in claim 4 wherein the locking member is a radial protrusion that extends radially outwardly from an outer surface of the retainer body to engage one of the grooves in the retainer-receiving holder.

6. The plug as claimed in claim 5 wherein the indexable terminal retainer comprises a plurality of equally spaced anti-rotation locking ribs extending longitudinally along the outer surface of the retainer body for engaging respective grooves in the retainer-receiving holder.

7. A receptacle for a modular wiring system, the receptacle comprising:

a receptacle body having a retainer-receiving holder;

an indexable terminal retainer having a cylindrical retainer body that retains only a single terminal, the retainer body having a body dimensioned to fit within the retainer-receiving holder, wherein the retainer-receiving holder defines a cylindrically shaped socket that matches the cylindrical retainer body; and a locking member for locking the retainer body to the retainer-receiving holder to prevent rotation of the retainer body, wherein the locking member is shaped to fit within one of a plurality of identically shaped but differently oriented grooves in the retainer-receiving holder.

8. The receptacle as claimed in claim 7 wherein the locking member is a radial protrusion that extends radially outwardly from an outer surface of the retainer body to engage one of the grooves in the retainer-receiving holder.

9. The receptacle as claimed in claim 8 wherein the indexable terminal retainer comprises a plurality of equally spaced anti-rotation locking ribs extending longitudinally along the outer surface of the retainer body for engaging respective grooves in the retainer-receiving holder.

10. A method for assembling a plug or receptacle for a modular wiring system, the method comprising:

providing an indexable terminal retainer having a cylindrical retainer body that retains only a single terminal;

rotating the indexable terminal retainer to a desired angular orientation relative to a terminal-receiving holder in the plug or receptacle, wherein the terminal-receiving holder defines a cylindrically shaped socket that matches the cylindrical retainer body; and installing the indexable terminal retainer in one of a plurality of identically shaped but differently oriented grooves in the retainer-receiving holder of the plug or receptacle to lock the indexable terminal retainer at the desired angular orientation.

11. The method as claimed in claim 10 wherein installing the indexable terminal retainer comprises inserting one or more radial protrusions that extend radially outwardly from an outer surface of the retainer body into respective grooves in the retainer-receiving holder.

* * * * *